US006976429B2

(12) United States Patent
Strasser et al.

(10) Patent No.: US 6,976,429 B2
(45) Date of Patent: Dec. 20, 2005

(54) METHOD FOR TIGHTENING AN EMBOSSING PLATE RING ON A CHUCK

(75) Inventors: Georg Strasser, Halden (CH); Edouard Borel, Dommartin (CH)

(73) Assignee: Bobst, S.A., (CH)

( * ) Notice: Subject to any disclaimer, the term of this patent is extended or adjusted under 35 U.S.C. 154(b) by 0 days.

(21) Appl. No.: 10/899,632

(22) Filed: Jul. 26, 2004

(65) Prior Publication Data

US 2005/0081730 A1 Apr. 21, 2005

(30) Foreign Application Priority Data

Jul. 25, 2003 (CH) ..... 01301/03

(51) Int. Cl.[7] ..... F28F 5/02; B44B 5/02

(52) U.S. Cl. ..... 101/487; 101/25; 101/31; 101/375; 492/46

(58) Field of Search ..... 101/8, 9, 21, 22, 101/23, 25, 27, 28, 31, 32, 216, 217, 375, 101/487; 492/21, 46, 48

(56) References Cited

U.S. PATENT DOCUMENTS

| | | | | |
|---|---|---|---|---|
| 4,197,798 | A * | 4/1980 | Bardin | 101/153 |
| 5,937,759 | A * | 8/1999 | Mitsam et al. | 101/378 |
| 6,125,753 | A | 10/2000 | Moscato et al. | 101/375 |
| 6,389,965 | B1 | 5/2002 | Weiler et al. | 101/217 |
| 6,640,711 | B2 | 11/2003 | Smoot et al. | 101/375 |
| 2003/0031812 | A1 | 2/2003 | Lemble et al. | 428/34.9 |
| 2004/0035305 | A1 * | 2/2004 | Strasser | 101/6 |
| 2005/0005787 | A1 * | 1/2005 | Roos | 101/25 |

* cited by examiner

*Primary Examiner*—Leslie J. Evanisko
(74) *Attorney, Agent, or Firm*—Ostrolenk, Faber, Gerb & Soffen, LLP

(57) ABSTRACT

A method for tightening an embossing plate ring on a chuck of a rotary embossing press, wherein the chuck is intended to be connected to a heater for leading the embossing plate ring to a working temperature. Between the chuck and the embossing plate ring is a split transmission ring made of a material having an expansion coefficient which is higher than that of materials used for the chuck and the embossing plate ring to cause the blocking of the embossing plate ring onto the chuck at the working temperature of the embossing plate ring.

7 Claims, 2 Drawing Sheets

METHOD FOR TIGHTENING AN EMBOSSING PLATE RING ON A CHUCK

BACKGROUND OF THE INVENTION

The present invention refers to a method for tightening an embossing plate ring on a chuck of a rotary embossing press, wherein the chuck is intended to be connected to heating means for leading the ring to its working temperature. The invention may be used in a rotary press such as the press disclosed in U.S. application Ser. No. 10/643,615, which is U.S. Publication No. U.S. 2004/0035305 A1, incorporated by reference.

The fastening of hot processing embossing plates, which are heated by thermic transfer from the chuck of a rotary embossing press on which the embossing plates are fastened, causes problems that are not easily solvable and known solutions show various drawbacks. Fastening the embossing plates with screws has a drawback that the screws fastened into the chuck wall, where the wall is heated through an oil circulation, require that the holes obturated by screws should not extend through the wall of the chuck. Moreover, such an operation requires time. To overcome the problem due to this fastening method, one has already thought of enclosing the chuck with a honeycomb structure into which the embossing plates can easily be secured in the requested position.

On the one hand, that solution enables eliminating the screws and makes it easier to fasten the embossing plates. But, on the other hand, it strongly penalizes the thermic transfer between the heated chuck and the embossing plates, insofar as it greatly reduces the thermic transferring surface between the chuck and the embossing plates. This is a relatively important drawback related to the rotary embossing press capacities.

SUMMARY OF THE INVENTION

The present invention aims to meet at least partly the difficulties with the above mentioned solutions.

To this aim, the present invention concerns a method for tightening an embossing plate ring onto a chuck of a rotary embossing press, wherein the chuck is provided with heating means for leading the embossing plate ring to its working temperature. In particular, the respective inside and outside diameters of the chuck within the split transmission ring around it, of the embossing plate ring around the split transmission ring and of the latter ring are selected to provide small clearances between them which close upon heating of the chuck and the embossing plate ring. The metal materials of the elements help achieve that. The invention may be used with a rotary press as disclosed in U.S. application Ser. No. 10/643,615, Publication No. 2004/0035305, which is incorporated by reference.

The advantages of the present invention mainly rest in the fact that an easy method makes mounting of the embossing plates onto the chuck easier, or the fastening is automatically carried out during a heating operation and this also ensures an optimum thermic transfer between the chuck and the embossing plates at the time the rotary press is running.

The accompanying drawings show, schematically and by way of example, an embodiment of the method related to the present invention.

DESCRIPTION OF PREFERRED EMBODIMENT

Figure 1:
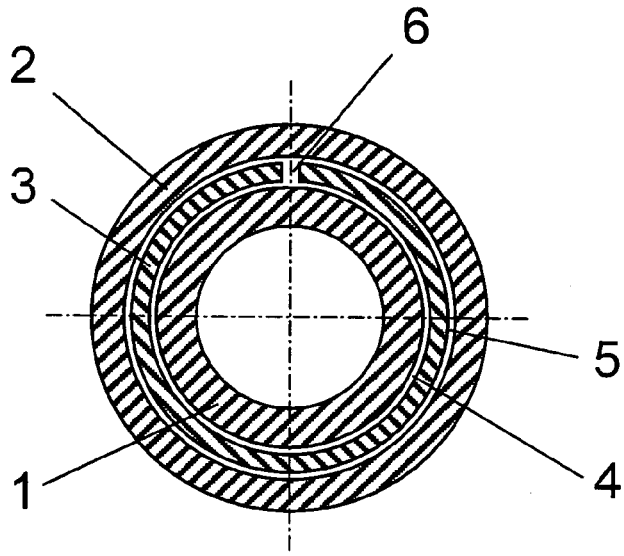
FIG. 1 is a transverse section view of the positioning of an embossing plate ring on a chuck at ambient temperature.
Figure 2:
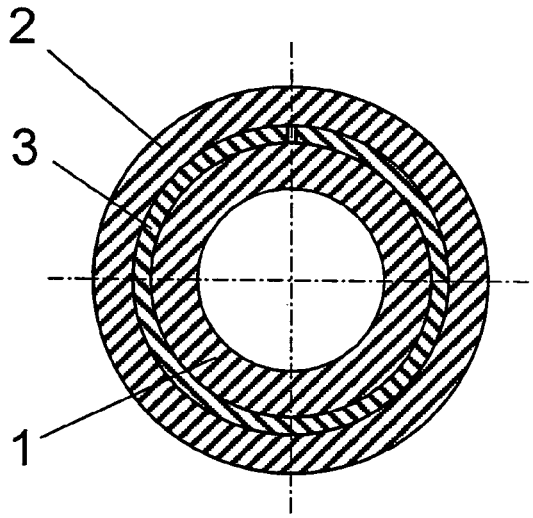
FIG. 2 is a section view of the chuck and the embossing plate ring heated to a working temperature.

FIG. 1 shows a sunken chuck 1 of a rotary embossing press, into which a heating liquid produced by a heater circuit (not shown), to which the chuck 1 is intended to be connected, is conveyed for heating the latter. The embossing plate intended to be fastened on the chuck is shaped like a ring 2. A split transmission ring 3 is arranged between the embossing plate ring 2 and the chuck 1.

There are voluntarily drawn in exaggerated proportion and with an explanatory aim, clearances 4 and 5 between the chuck 1 and the split transmission ring 3, on the one hand, and between the split transmission ring 3 and the embossing plate ring 2, on the other hand. As the transmission ring is split, there could alternatively be a clearance only between the ring 3 and the embossing plate 2. In practice, the entire clearance between the chuck 1 and the embossing plate ring 2 is about hundreds of millimeters. That clearance relates to materials used for the three devices, chuck 1, split transmission ring 3 and embossing plate ring 2, as well as to the diameter of the chuck 1, as that diameter typically ranges from 127 to 254 millimeters.

According to an embodiment of the fastening method, the chuck 1 is made of steel, the embossing plate ring 2 of brass and the split transmission ring 3 of aluminum. Since the expansion coefficient of aluminum is higher than that of steel and that of brass, the clearance(s) between the chuck 1 and the split transmission ring 3 and between the split transmission ring and the embossing plate ring 2 are eliminated which causes the tightening of the embossing plate ring 2 onto the chuck 1.

As shown in a specific example, the chuck 1 has a diameter of 140 millimeters, the split transmission ring 3 has an external diameter of 156 millimeters and the embossing plate ring 2 has an external diameter of 190 millimeters. The entire clearance between them all ranged from 3 to 5 hundreds of millimeters. This clearance disappeared at a temperature of the chuck 1 of 150° C., resulting in a perfect locking of the embossing plate ring 2 on the chuck 1 at a working temperature which oscillates around about 200° C. The split 6 afforded on the split transmission ring 3 enables absorbing the circular expansion of the transmission ring at the time of heating the chuck 1.

More usually, the clearance(s) which are distributed between the chuck 1, the embossing plate ring 2, on the one hand, and the split transmission ring 3, on the other hand, has or have to be less than the expansion difference between the split transmission ring 3 and the two other parts, thus enabling the dilatation or expansion differential of the transmission ring canceling the clearance(s) and ensuring the locking of the embossing plate ring 2 onto the chuck 1.

The fastening method makes the assembly of the embossing plates on the chuck extremely easy due to the existing clearance(s) between the different assembly devices. Even if there is no clearance between the chuck 1 and the split transmission ring 3, the transmission ring being split enables its easy positioning. The tightening of the three assembly parts moreover ensures an optimal thermic transfer between the chuck 1 and the embossing plates interdependent of the embossing plates rings, and more particularly since the split transmission ring 3 is made of aluminum.

Figure 3:
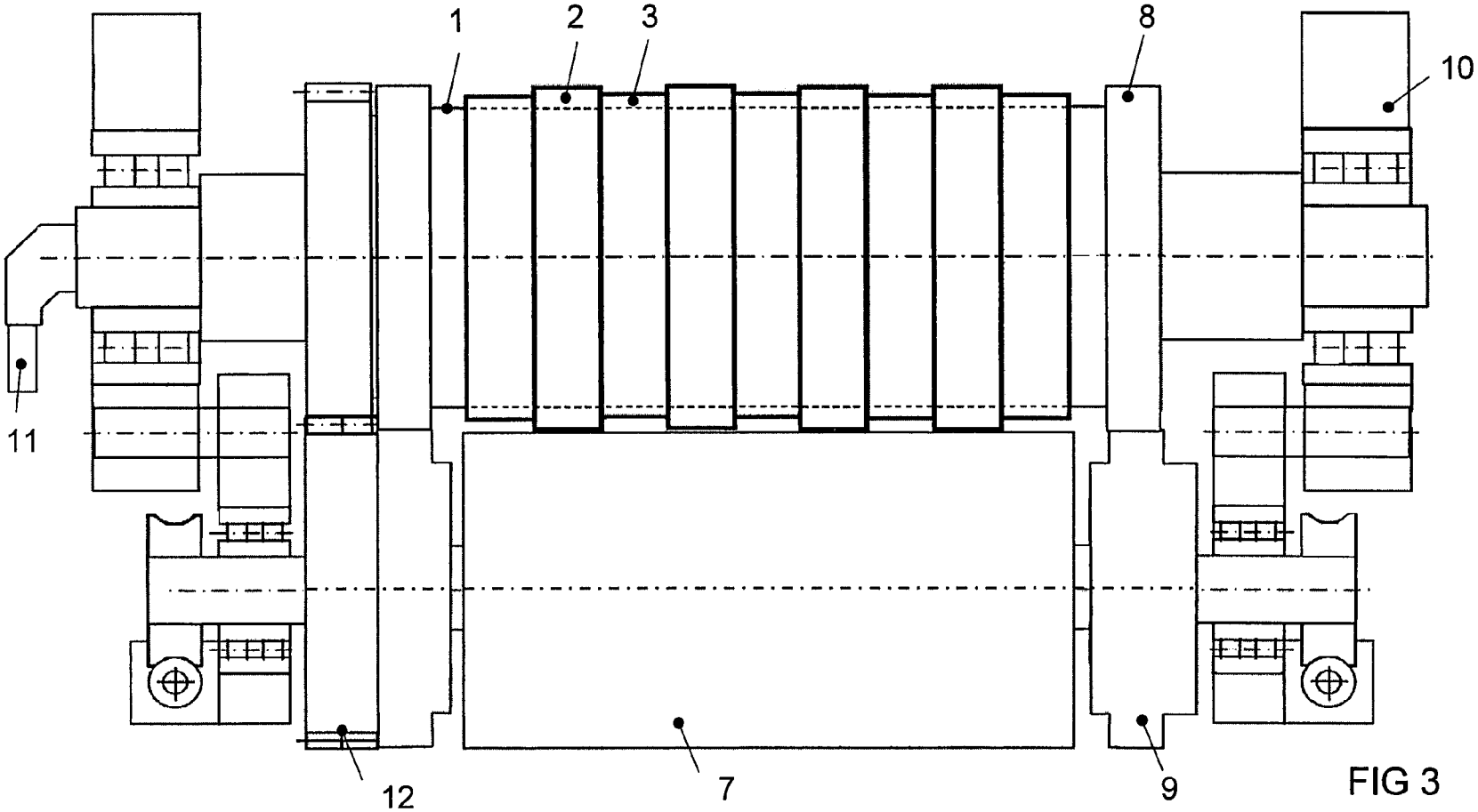
FIG. 3 is a view across a rotary press in which the invention may be incorporated.

A rotary press incorporating the invention is seen in FIG. 3 hereof, for example of a type shown in above mentioned U.S. application Ser. No. 10/643,615, Publication No. U.S. 2004 0035305, incorporated by reference. The chuck 1 is a cylinder connected between upper bearing rings 8 supported at the tool suspension areas 10. There is a heating oil system at 11 for the chuck 1.

The embossing plate ring 2 is in several segments along the chuck axis and over the split transmission ring. The embossing plate ring 2 forms a nip with the counter cylinder 7. That cylinder 7 is supported in the lower bearing rings 9. Gears 12 drive rotation of the chuck cylinder 1 and the counter cylinder 7.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Method for tightening an embossing plate ring on a chuck of a rotary press, wherein the chuck is intended to be connected to a heater for leading the embossing plate ring to a working temperature, the method comprising:

placing a split transmission ring between the chuck and the embossing plate ring, wherein the split transmission ring is of a material having an expansion coefficient that is higher than respective expansion coefficients of respective materials of which the chuck and the embossing plate ring are comprised, and the expansion coefficients of the materials being selected to cause locking of the embossing plate ring onto the chuck to the working temperature of the embossing plate ring.

2. The tightening method according to claim 1, wherein the chuck within the transmission ring and the transmission ring have respective facing sides, and the transmission ring within the embossing plate ring also have respective facing sides; the chuck, the split transmission ring and the embossing plate ring are produced with respective diameters of the facing sides thereof to provide respective clearances between the facing sides at ambient temperature which is lower than a thermic radial differential dilation between the chuck and the embossing plate ring, on the one hand, and the split transmission ring, on the other hand.

3. The tightening method according to claim 2, wherein the chuck is made of steel, the embossing plate ring is made of brass and the transmission ring is made of aluminum.

4. The tightening method according to claim 2, further comprising heating the chuck with the heater for leading the embossing plate ring to working temperature, wherein the heating is for causing such expansion as to eliminate the clearances at ambient temperature.

5. The tightening method according to claim 1, wherein the chuck is made of steel, the embossing plate ring is made of brass and the transmission ring is made of aluminum.

6. The tightening method according to claim 1, further comprising heating the chuck with the heater for leading the embossing plate ring to working temperature.

7. A rotary press with an embossing plate ring comprising:

a rotary press; a chuck supported for rotation on the rotary press, a heater connected to the chuck for leading the embossing plate ring to a working temperature;

a split transmission ring between the chuck and the embossing plate ring, wherein the split transmission ring is made of a material having an expansion coefficient that is higher than respective expansion coefficients of respective materials used for making the chuck and the embossing plate ring, the expansion coefficients of the materials being selected to cause locking of the embossing plate ring onto the chuck to the working temperature of the embossing plate ring.

* * * * *